United States Patent [19]

Goyarts

[11] Patent Number: 4,767,901

[45] Date of Patent: Aug. 30, 1988

[54] PROCESS FOR MAKING AN ENCLOSURE OUTLET CONNECTION DEVICE

[75] Inventor: Wynand M. Goyarts, Abingdon, Va.

[73] Assignee: Simmons-Rand Corporation, Bristol, Va.

[21] Appl. No.: 52,173

[22] Filed: May 4, 1987

Related U.S. Application Data

[63] Continuation of Ser. No. 684,943, Dec. 21, 1984, abandoned.

[51] Int. Cl.[4] ..... H01H 9/14; H01H 9/30

[52] U.S. Cl. ..... 200/306; 384/206; 361/215; 29/622; 200/330; 200/155 R; 200/6 A

[58] Field of Search ..... 384/206; 200/304, 305, 200/306, 336, 302.1, 155 R, 144 R, 148 R, 148 C, 330, 331, 6 A; 29/622; 361/215

[56] References Cited

U.S. PATENT DOCUMENTS

| | | | |
|---|---|---|---|
| 1,562,130 | 11/1925 | Stitzinger | 384/206 X |
| 2,156,564 | 5/1939 | Hardage | 200/302.1 |
| 2,240,922 | 5/1941 | Bissell | 200/302.1 |
| 2,287,650 | 6/1942 | Tornblom | 200/302.1 |
| 2,309,281 | 1/1943 | Steele | 384/206 X |
| 3,116,539 | 1/1964 | Evans et al. | 384/206 X |
| 3,728,511 | 4/1973 | George et al. | 200/336 |
| 4,302,638 | 11/1981 | Fox et al. | 200/306 X |
| 4,389,555 | 6/1983 | Guinan | 200/303 |

FOREIGN PATENT DOCUMENTS

| | | | |
|---|---|---|---|
| 1070740 | 1/1980 | Canada | 200/306 |
| 689810 | 11/1939 | Fed. Rep. of Germany | 200/331 |
| 2444994 | 4/1976 | Fed. Rep. of Germany | 200/304 |

*Primary Examiner*—Henry J. Recla
*Assistant Examiner*—Ernest G. Cusick
*Attorney, Agent, or Firm*—D. W. Tibbott

[57] ABSTRACT

An outlet connection device transfers motion from outside to inside an explosion proof enclosure and includes a process for using a self-aligning bearing retained in a wall of the enclosure. The self-aligning bearing has flame paths selected to meet minimum safety requirements and contains a shaft for transferring either rotary, axial or joy-stick motion into the enclosure. In a rotary transfer arrangement an electric rotary switch is connected through a blade engaging the shaft passing through the self-aligning bearing.

9 Claims, 1 Drawing Sheet

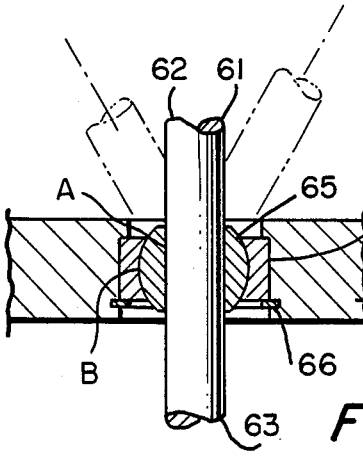
FIG. 3
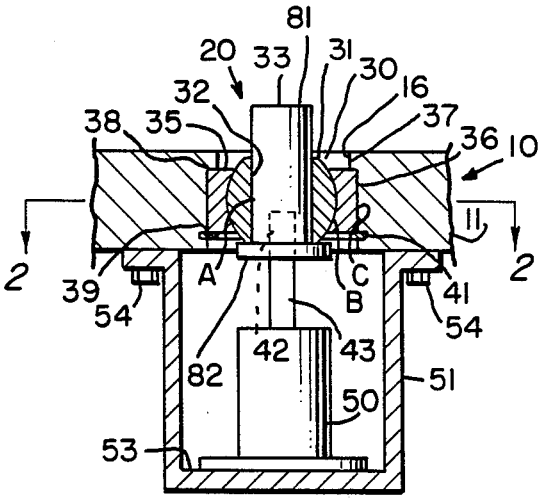
FIG. 1
FIG. 2
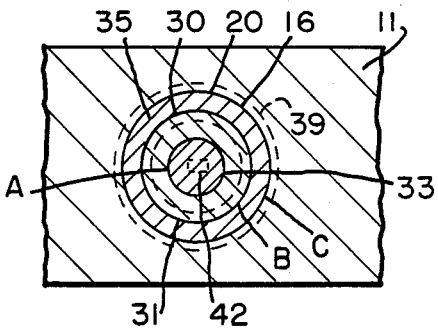
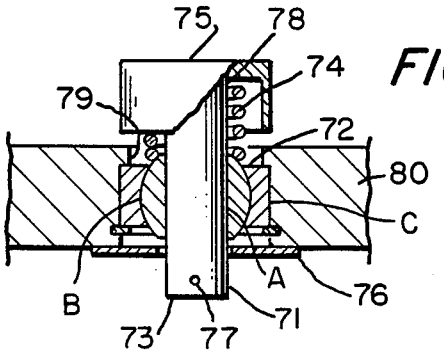
FIG. 4

PROCESS FOR MAKING AN ENCLOSURE OUTLET CONNECTION DEVICE

This is a continuation of application Ser. No. 684,943, filed Dec. 21, 1984, now abandoned.

BACKGROUND OF THE INVENTION

This invention relates to a process for making outlet connection devices, particularly connection devices for transferring mechanical motion into explosion-proof enclosures.

In many applications such where mining equipment is used it is necessary to provide electrical switching enclosures that are designed to be explosion proof. The switching is usually accomplished by transferring mechanical motion from the outside to the inside of the enclosure. The devices used to transfer motion require certain physical characteristics to ensure that the electrical flashes that occur during switching are not communicated to the atmosphere which may contain explosive mixtures. The equipment presently used in potentially explosive mining conditions generally have costly sealing mechanisms to maintain the required distance of separation, or flame path, between the inside of the enclosure and the atmosphere.

SUMMARY OF THE INVENTION

With this invention a process for making a connection device uses a self-aligning bearing of a type generally available in the art as the central mechanism for the transmission of motion into an explosion proof enclosure. The requirements for preventing external explosions created by the sparking occurring in an enclosure are readily met by providing the required minimum flame path lengths. In addition the flexibility and ease of this process permits mounting the device at any convenient position on an enclosure.

The advantages of the invention will be apparent from the following description.

BRIEF DESCRIPTION OF THE DRAWING

FIG. 1 is a cross-sectional view of an explosion-proof outlet according to this invention;

FIG. 2 is a view taken along line 2—2 of FIG. 1;

FIGS. 3 and 4 are cross-sectional views of other outlets according to this invention.

DESCRIPTION OF THE PREFERRED EMBODIMENT

Referring to FIGS. 1 and 2, an explosion proof enclosure 10 of any type known in the art has a wall 11 with an opening 16 for receiving a motion transfer or enclosure outlet device 20 for transferring rotary motion from outside to inside the enclosure. An electrical assembly includes an enclosure outlet device 20 and a rotary switch 50 is mounted by a frame 51 on the inside of the enclosure and is connected to respond to the rotary motion provided through device 20.

Opening 16 has a configuration adapted to receive a self-aligning bearing 30 of any type known in the art. Such self-aligning bearings are manufactured by and available from several sources for applications in which a bearing surface for a rotating or swiveling shaft is required. These self-aligning bearings are easily positioned to readily transmit mechanical motion. Bearing 30 comprises a spherical ball 31 having an annular opening 32 that is adapted to and receives a shaft 33 in a tightly receiving relationship. Ball 31 is made of brass or steel and rotates in a ball and socket arrangement with an exterior ball retaining joint casing 35 that partially surrounds ball 31. Shaft 33 extends from an upper end 81 outside of the enclosure to a lower end 82 within the enclosure.

Casing 35 is tightly fitted into opening 16 which has a larger cross-sectional area 36 and a narrower cross-sectional area 37 to create a lip 38. A retaining washer 39 inserted in an annular groove 41 maintains the self-aligning bearing structure in place by securing it tightly against lip 38. A slot 42 in shaft 33 is positioned to receive a connecting blade arm 43 from rotary switch 50 at lower end 82. Connecting blade arm 43 extends upwardly from switch 50 and engages slot 42. Switch 50 is mounted on frame 51 along a surface 53 and frame 51 is connected to wall 11 by bolts 54.

In order to meet the standards of explosion proof enclosures, it is necessary that the flame paths between the inside and outside enclosure be certain minimal lengths. These flame paths are the abutting surfaces A, B and C between shaft 33 and ball 31, between ball 31 and casing 35, and between casing 35 and wall 11, respectively. The length can be selected to ensure meeting the required minimum flame path length for an application.

In the operation of the switching mechanism shown in FIGS. 1 and 2 the rotary movement of shaft 33 is transferred through blade arm 43 to switch 51.

Referring to FIG. 3 a mechanism similar to that shown in FIGS. 1 and 2 comprises a shaft 61 with an external end 62 and internal end 63 contained in a self-aligning bearing 65 mounted in a hole 66 in a wall 67 in the same manner as shown in FIG. 1. Movement of end 62 in a joy stick configuration enables transfer of a joy stick movement to end 63 for use by any suitable device.

Referring to FIG. 4 a mechanism similar to that shown in FIGS. 1 and 3 has a push button configuration with a shaft 71, a self-aligning bearing 72 mounted in a hole 79 in a wall 80 in the same manner as shown in FIG. 1, an internal end 73, an external end 78, a spring 74, a push button cap 75 attached to the shaft at the external end, and a retaining washer 76 and a pin 77. Push button cap 75 and shaft 71 are biased upwardly by spring 74 acting between cap 75 and bearing 72. Upon depression of push button cap 75 motion is transferred by shaft 71 to a switching mechanism having a push button motion (not shown) in any manner known in the art.

I claim:

1. A process of using a self-aligning bearing assembly having a ball and socket assembly mounted in an opening in an enclosure, said enclosure is defined by walls so as to have an inside and an outside and containing electrical equipment which may generate arcing, said ball and socket assembly having an annular opening adapted to receive a shaft within said annular opening, and a shaft passing through the annular opening in a tightly receiving relationship to transfer motion along the shaft and said ball and socket assembly, said shaft and said opening of said enclosure defining abutting surfaces, said assembly having a thickness selected to provide a minimum flame path length able to extinguish arcing along said abutting surfaces of the bearing assembly, said process comprising mounting said bearing assembly in said opening of said enclosure containing electrical equipment to enable transfer of motion by movement of the shaft from outside to inside the enclosure whereby any arcing generated by said electrical equipment is extinguished by passing along said abutting surfaces.

2. A process according to claim 1 also comprising connecting electrical equipment within the enclosure to the shaft to receive motion transferred along the shaft.

3. A process according to claim 2 also comprising arranging the connection between the electrical equipment and the shaft to enable the shaft to transmit side-to-side motion to the electrical equipment in a joy-stick fashion.

4. A process according to claim 2 also comprising arranging the connection between the electrical equipment and the shaft to enable the shaft to transmit rotary motion to the electrical equipment.

5. A process according to claim 2 also comprising arranging the connection between the electrical equipment and the shaft to enable the shaft to transmit axial motion to the electrical equipment in a push or pull fashion.

6. A process of using a self-aligning bearing assembly having a ball and socket assembly mounted in an opening in an enclosure, said enclosure is defined by walls so as to have an inside and outside and containing electrical equipment which may generate arcing, said ball and socket assembly having an annular opening to receive a shaft within said opening and a shaft passing through the annular opening in a tightly receiving relationship to transfer motion along the shaft and said ball and socket assembly, said shaft and said opening of said enclosure defining abutting surfaces, said assembly having a thickness selected to provide a minimum flame path length able to extinguish arcing along said abutting surfaces from outside to inside the enclosure when said bearing assembly is mounted in said opening of said enclosure, said shaft is movable in a joy-stick configuration to transfer motion along the shaft, said process comprising mounting said bearing assembly in said opening of said enclosure containing electrical equipment to enable transfer of motion by movement of the shaft from outside to inside the enclosure whereby any arcing generated by said electrical equipment is extinguished by passing along said abutting surfaces.

7. A process according to claim 6 also comprising connecting electrical equipment within the enclosure to the shaft to receive motion transferred along the shaft.

8. A process of using a self-aligning bearing assembly having a ball and socket assembly mounted in an opening in an enclosure, said enclosure is defined by walls so as to have an inside and an outside and containing electrical equipment which may generate arcing, said, ball and socket assembly having an annular opening adapted to receive a shaft within said annular opening, and a shaft passing through said annular opening in a tightly receiving relationship to transfer motion along the shaft and said ball and socket assembly, said shaft and said opening of said enclosure defining abutting surfaces, said process comprising a minimum flame path length able to extinguish arcing along said abutting surfaces of the bearing assembly, and mounting said bearing assembly in an opening of an enclosure containing electrical equipment to enable transfer of motion by movement of the shaft from outside to inside the enclosure whereby any arcing generated by said electrical equipment is extinguished by passing along said abutting surfaces.

9. A process according to claim 8 also comprising connecting electrical equipment within the enclosure to the shaft to receive motion transferred along the shaft.

* * * * *